US010492588B2

(12) United States Patent
Shen

(10) Patent No.: US 10,492,588 B2
(45) Date of Patent: Dec. 3, 2019

(54) COSMETIC CONTAINER

(71) Applicant: HJS PACKAGING CO., LTD., Tainan (TW)

(72) Inventor: Mu-Chuan Shen, Tainan (TW)

(73) Assignee: HJS PACKAGING CO., LTD, Tainan (TW)

( * ) Notice: Subject to any disclaimer, the term of this patent is extended or adjusted under 35 U.S.C. 154(b) by 493 days.

(21) Appl. No.: 15/465,768

(22) Filed: Mar. 22, 2017

(65) Prior Publication Data

US 2017/0273439 A1 Sep. 28, 2017

(30) Foreign Application Priority Data

Mar. 23, 2016 (TW) ..... 105204042 U

(51) Int. Cl.
*A45D 40/22* (2006.01)

(52) U.S. Cl.
CPC ..... *A45D 40/222* (2013.01); *A45D 2040/225* (2013.01)

(58) Field of Classification Search
CPC ..... A45D 40/222; A45D 2040/225; A45D 2040/224; A45D 40/22; A45D 40/00; A45D 34/00; A45D 33/00; B65D 45/025; B65D 45/322; B65D 83/04
See application file for complete search history.

(56) References Cited

U.S. PATENT DOCUMENTS

| | | | | | |
|---|---|---|---|---|---|
| D655,045 | S * | 2/2012 | Paschoal | D28/83 | |
| D722,205 | S * | 2/2015 | Parker | D28/83 | |
| D730,581 | S * | 5/2015 | Hwang | D28/83 | |
| 2002/0185404 | A1* | 12/2002 | Donegan | B65D 77/02 206/531 | |
| 2006/0138157 | A1* | 6/2006 | Timm | A45D 33/006 220/839 | |

* cited by examiner

*Primary Examiner* — Andrew T Kirsch
*Assistant Examiner* — Don M Anderson
(74) *Attorney, Agent, or Firm* — Royse Law Firm, PC

(57) ABSTRACT

A cosmetic container includes a container body and a cover. The container body includes a base wall, two first lateral walls, and two second lateral walls interconnecting the first lateral walls. Each of the second lateral walls has two end sections and a holding section disposed therebetween. The holding section is connected to the base wall and has a curved portion that cooperates with the base wall to form a rounded corner, a bending portion that is connected to a top end of the curved portion, and a depressed portion that extends upward from the bending portion, that is depressed toward the other one of the second lateral walls, and that defines a lower groove. The cover is pivotally connected to the container body.

9 Claims, 7 Drawing Sheets

COSMETIC CONTAINER

CROSS-REFERENCE TO RELATED APPLICATION

This application claims priority of Taiwanese Patent Application No. 105204042, filed on Mar. 23, 2016.

FIELD

The disclosure relates to a container, and more particularly to a cosmetic container.

BACKGROUND

Referring to FIG. 1, a conventional cosmetic container includes a container body 11, and a cover 12 pivotally connected to and openably covering the container body 11. The container body 11 has a circular bottom wall 111, and a surrounding wall 112 extending vertically upward from a periphery of the bottom wall 111. Since an angle formed between the bottom wall 111 and the surrounding wall 112 is a right angle, and since the bottom wall 111 is circular, it is relatively difficult for a user to stably hold the cosmetic container, and the cosmetic container may easily slip and fall off. In addition, the user's fingers are subject to a relatively large pressure when holding the conventional cosmetic container at the juncture between the bottom wall 111 and the surrounding wall 112 (i.e., where the right angle is formed), and such holding action may leave a dent mark on the user's fingers.

Referring to FIG. 2, another conventional cosmetic container includes a lower container body 13, and an upper container body 14 pivotally connected to and openably covering the lower container body 13. The lower container body 13 has a lower base wall 131, and a lower surrounding wall 132 that vertically extends upward from the lower base wall 131. The upper container body 14 has an upper base wall 141, and an upper surrounding wall 142 that vertically extends downward from the upper base wall 141 toward the lower surrounding wall 132. Although the lower base wall 131 is not circular, holding the conventional cosmetic container at the juncture between the lower base wall 131 and the lower surrounding wall 132 may also leave a dent mark on the user's fingers. If the user instead holds the conventional cosmetic container by pressing the fingers against the upper and lower surrounding walls 142, 132 of the lower container body 13, the user's fingers may obstruct movement of the upper container body 14 when the upper container body 14 is pivoted upward to uncover the lower container body 13, and may get hurt when the upper container body 14 is pivoted downward to cover the lower container body 13. Therefore, there is room for improving the design of the abovementioned conventional cosmetic containers.

SUMMARY

Therefore, an object of the disclosure is to provide a cosmetic container that can alleviate at least one of the drawbacks of the prior arts.

According to the disclosure, the cosmetic container includes a container body and a cover.

The container body includes a base wall, two first lateral walls, and two second lateral walls. The first lateral walls are connected to the base wall and are spaced apart from each other in a front-rear direction. The second lateral walls are connected to the base wall, are spaced apart from each other in a left-right direction, and interconnect the first lateral walls. Each of the second lateral walls has two end sections that are respectively connected to the first lateral walls, and a holding section that is disposed between the end sections. The holding section has a curved portion that is connected to the base wall and that cooperates with the base wall to form a rounded corner, a bending portion that is connected to a top end of the curved portion, and a depressed portion that extends upward from the bending portion, that is depressed toward the other one of the second lateral walls, and that defines a lower groove extending to a top end of the holding section. The cover is pivotally connected to the container body for openably covering the container body.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
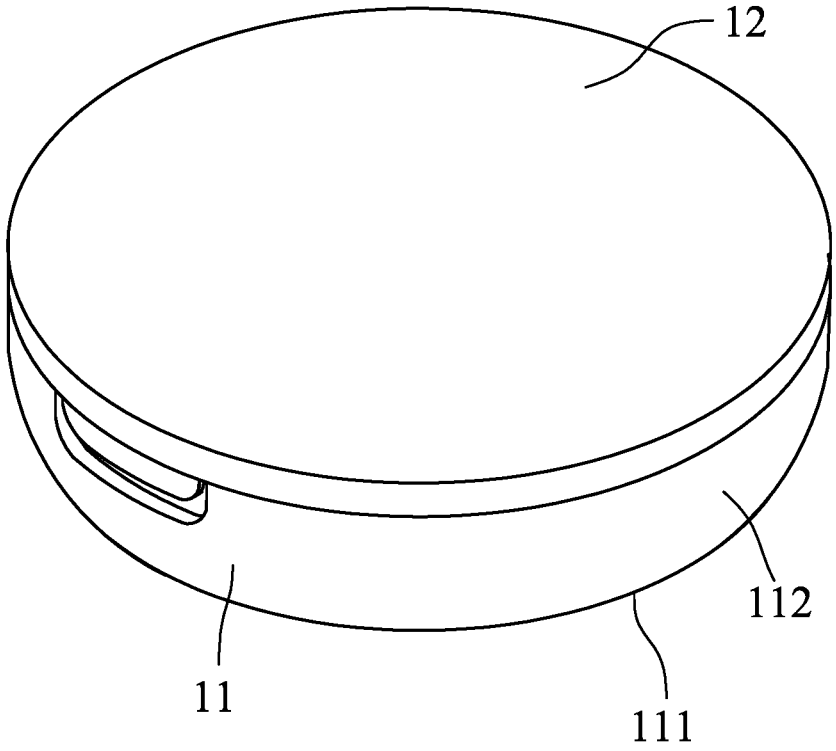
FIG.1 PRIOR ART
FIG. 1 is a perspective view illustrating a conventional cosmetic container.
Figure 2:
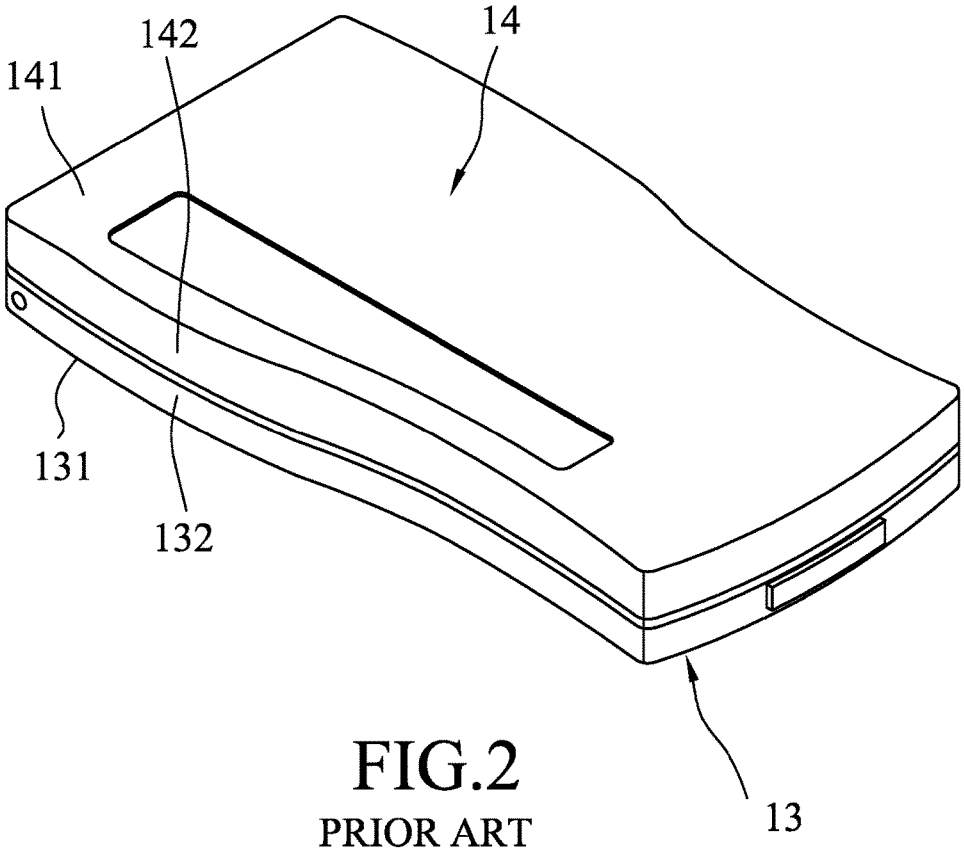
FIG.2 PRIOR ART
FIG. 2 is a perspective view illustrating another conventional cosmetic container.
Figure 3:
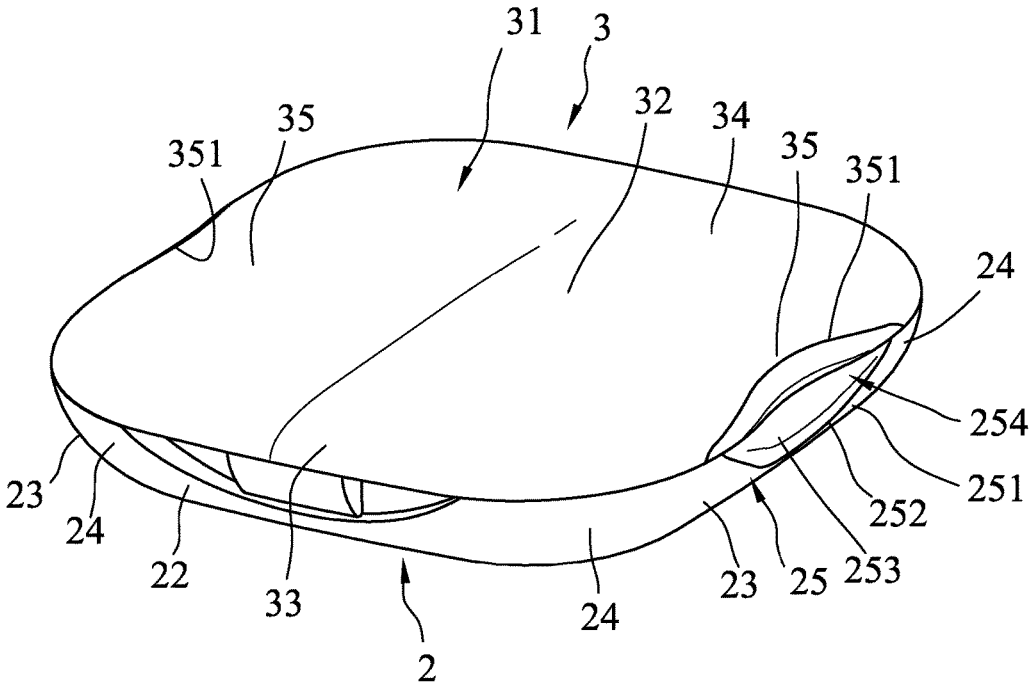
FIG. 3 is a perspective view illustrating an embodiment of a cosmetic container according to the disclosure.
Figure 4:
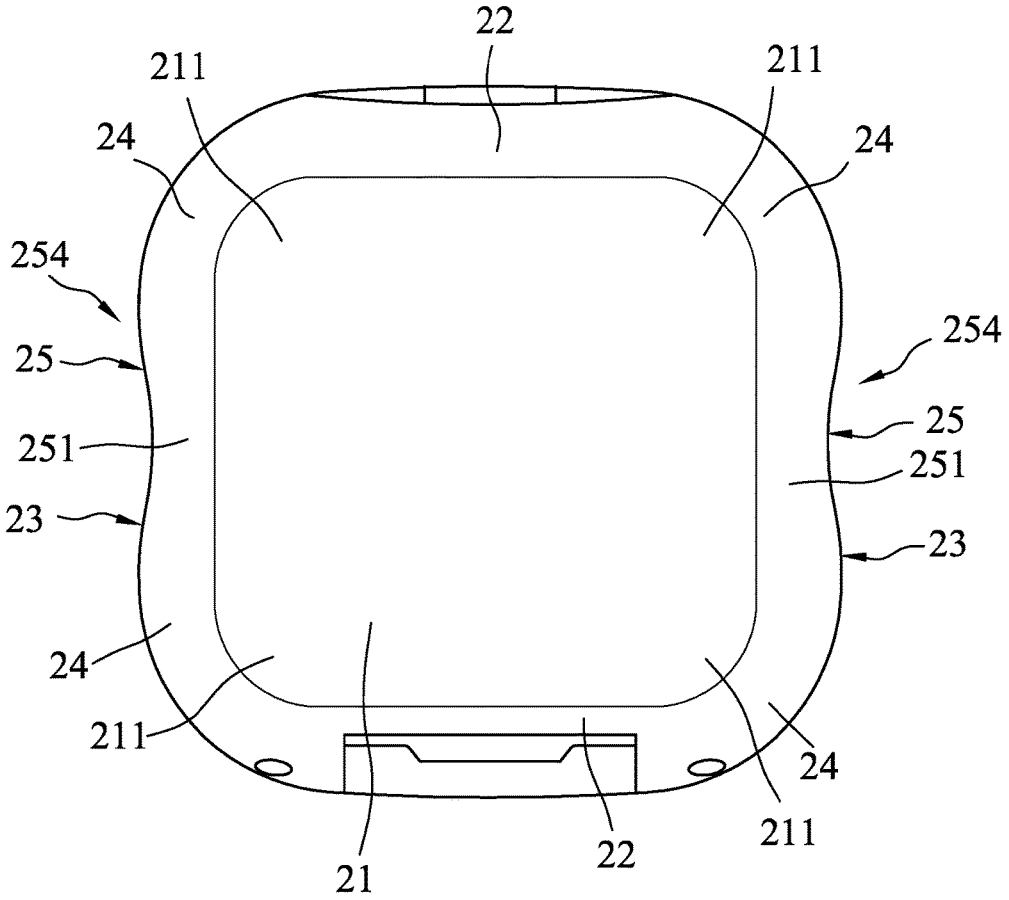
FIG. 4 is a bottom view of the embodiment.
Figure 5:
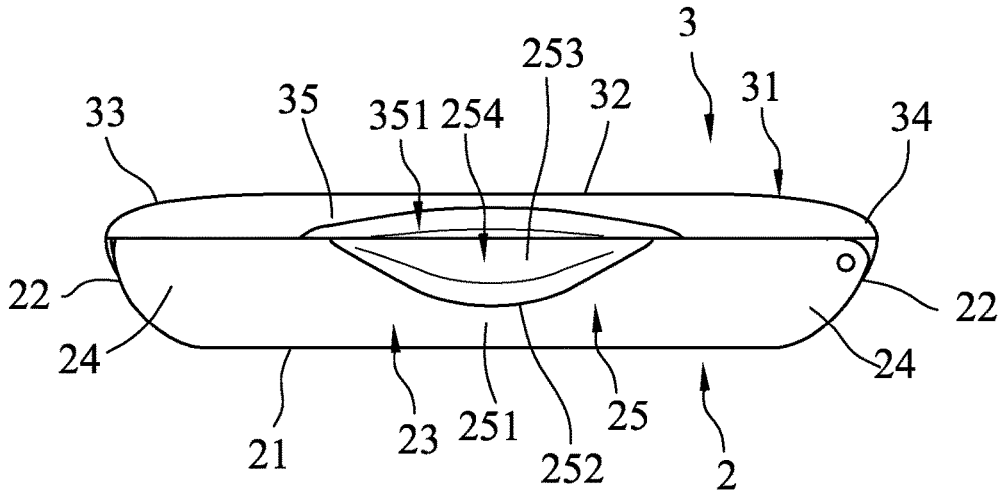
FIG. 5 is a side view of the embodiment.

Referring to FIGS. 3 to 5, an embodiment of a cosmetic container according to the disclosure includes a container body 2, and a cover 3 pivotally connected to the container body 2 for openably covering the container body 2.

The container body 2 is substantially cuboid in shape and has four rounded bottom corners. The container body 2 includes a base wall 21, two first lateral walls 22, and two second lateral walls 23.

The base wall 21 is substantially square-shaped, and has four corner portions 211 that are rounded. The first lateral walls 22 are connected to the base wall 21 and are spaced apart from each other in a front-rear direction. Each of the first lateral walls 22 cooperates with the base wall 21 to form an elongated rounded corner. The second lateral walls 23 are connected to the base wall 21, are spaced apart from each other in a left-right direction, and interconnect the first lateral walls 22. Each of the second lateral walls 23 has two end sections 24 that are respectively connected to the first lateral walls 22, and a holding section 25 that is disposed between the end sections 24. More specifically, each of the end sections 24 is connected to the base wall 21, cooperates with the base wall 21 to form a rounded corner, and is connected to the holding section 25. The holding section 25 is centrally located between the end sections 24, and has a curved portion 251, a bending portion 252, and a depressed portion 253. The curved portion 251 is connected to the base wall 21, and cooperates with the base wall 21 to form a rounded corner (i.e., for each of the second lateral walls 23, the curved portion 251 of the holding section 25 and the two end sections 24 cooperate with the base wall 21 to form an elongated rounded corner). The bending portion 252 is U-shaped, is connected to a top end of the curved portion 251, and opens upward. The depressed portion 253 extends upward from the bending portion 252, is depressed toward the other one of the second lateral walls 23, and defines a lower groove 254 extending to a top end of the holding section 25. The holding sections 25 of the second lateral walls 23 are symmetrical to each other in the left-right direction.

Figure 6:
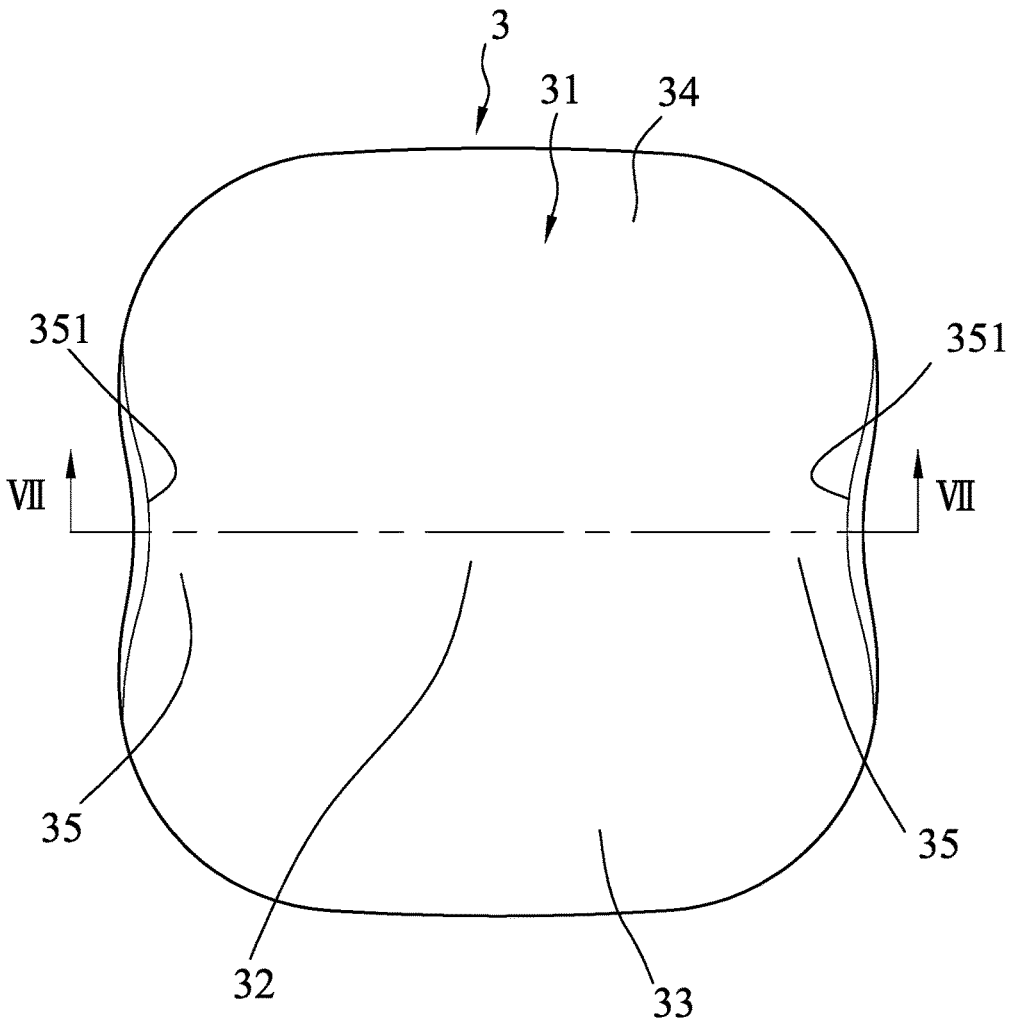
FIG. 6 is a top view of the embodiment.

Referring to FIGS. 3, 5, and 6, the cover 3 is substantially cuboid in shape and has four rounded top corners. The cover 3 includes a main wall 31 that has a flat top wall surface 32 located at a center part of the main wall 31, a front wall surface 33 and a rear wall surface 34 being spaced apart from each other in the front-rear direction and flanking the top wall surface 32, and two side wall surfaces 35 being spaced apart from each other in the left-right direction, flanking the top wall surface 32, and interconnecting the front and rear wall surfaces 33, 34. Each of the front, rear, and side wall surfaces 33, 34, 35 extends from a periphery of the top wall surface 32 toward the container body 2, and cooperates with the top wall surface 32 to form an elongated rounded corner. Each of the side wall surfaces 35 of the main wall 31 has a depressed section that is depressed toward the other one of the side wall surfaces 35, and that defines an upper groove 351 communicating with the lower groove 254 of a respective one of the second lateral walls 23 of the container body 2.

More specifically, each of the side wall surfaces 35 of the main wall 31 has a center part which is centrally located with respect to the front-rear direction and in which the upper groove 351 is located, such that the upper grooves 351 of the side wall surfaces 35 are symmetrical to each other in the left-right direction. In this embodiment, the center part is also centrally located with respect to a top-bottom direction which is perpendicular to the front-rear direction and the left-right direction, and the upper groove 351 of each of the side wall surfaces 35 extends downward from the center part toward the lower groove 254 of the respective one of the second lateral walls 23.

Figure 7:
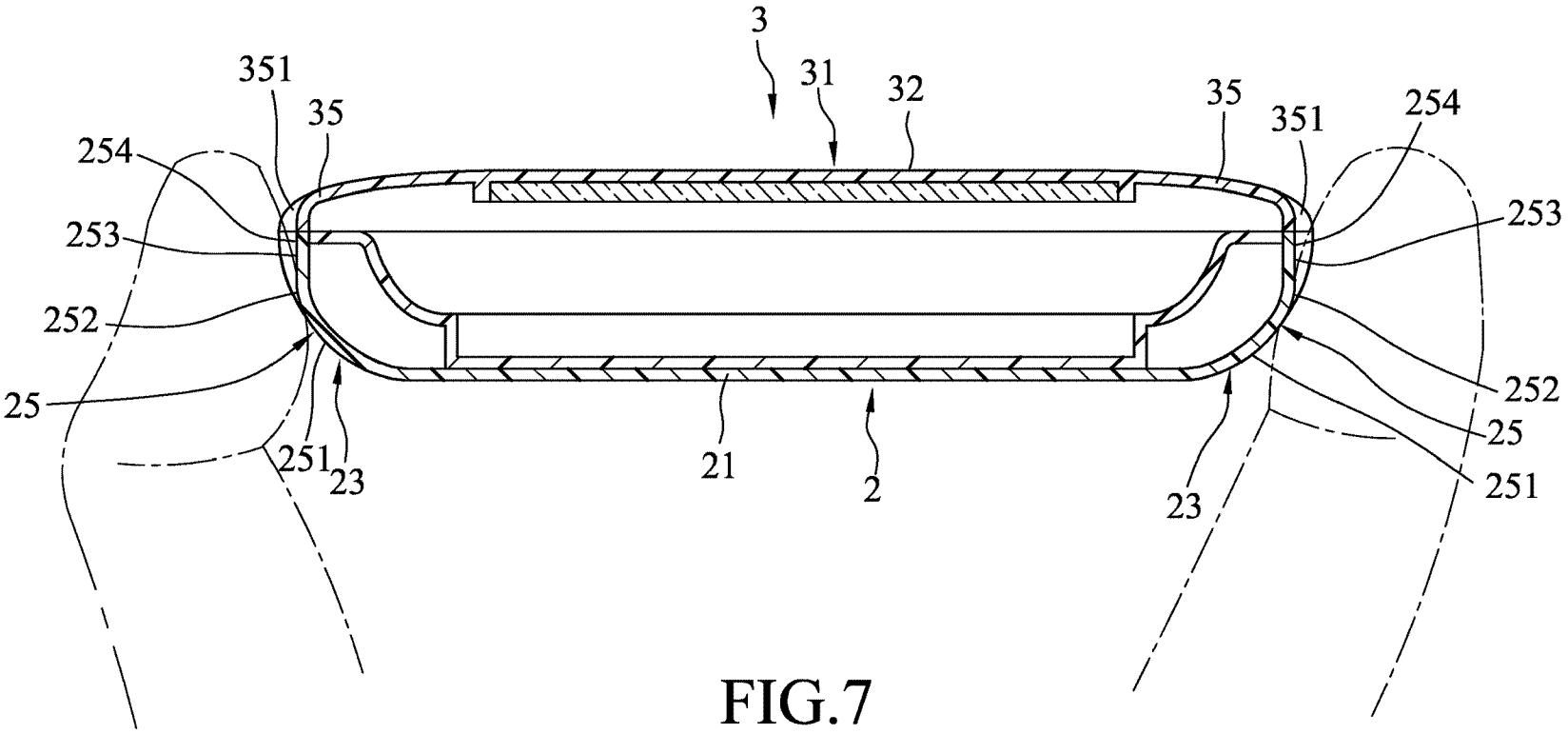
FIG. 7 is a schematic sectional view of the embodiment taken along line VII-VII in FIG. 6, illustrating a user's fingers holding the embodiment.

Referring to FIGS. 3, 5, and 7, when the cosmetic container is held, the user's fingers (e.g., a thumb and a middle finger of the user) press on the curved portions 251 and the bending portions 252 of the holding sections 25 of the second lateral walls 23. The curved portions 251 and the bending portions 252 are meticulously designed with no sharp pointed angle, so that less pressure is exerted on the user's fingers when the cosmetic container is held, thereby preventing the formation of dent marks on the fingers as described in the abovementioned prior arts. Furthermore, by virtue of the configurations of the depressed portions 253 of the holding sections 25 and the upper and lower grooves 351, 254, the user will instinctively place his/her fingers on the curved portions 251 and the bending portions 252 of the holding sections 25. That is, the user's fingers are in contact with the curved portions 251 and the bending portions 252 of the holding sections 25 and are not placed in the upper and lower groove 351, 254 when the cosmetic container is held, thereby preventing obstruction by the user's fingers when the cover 3 is pivoted upward to uncover the container body 2, and preventing the user's fingers from injury when the cover 3 is pivoted downward to cover the container body 2.

Moreover, the holding section 25 of each of the second lateral walls 23 is centrally located with the depressed portion 252 depressed toward the other one of the second lateral walls 23. As such, when the user's fingers press against the curve portions 251 and the bending portions 252, the cosmetic container is held in a relatively steady manner and is not easily fall off. In addition, the configurations of the upper and lower groove 351, 254 enable the user to quickly identify the orientation of the cosmetic container, which can be achieved by perceiving visually, or by perceiving tangibly the upper and lower grooves 351, 254 under deem light.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A cosmetic container comprising:

a container body including a base wall, two first lateral walls that are connected to said base wall and that are spaced apart from each other in a front-rear direction, and two second lateral walls that are connected to said base wall, that are spaced apart from each other in a left-right direction, and that interconnect said first lateral walls, each of said second lateral walls having two end sections that are respectively connected to said first lateral walls, and a holding section that is disposed between said end sections, and that has a curved portion that is connected to said base wall and that cooperates with said base wall to forma rounded corner, a bending portion that is connected to a top end of said curved portion, and a depressed portion that extends upward from said bending portion, that is depressed toward the other one of said second lateral walls, and that defines a lower groove extending to a top end of said holding section; and a cover pivotally connected to said container body for openably covering said container body.

2. The cosmetic container as claimed in claim 1, wherein:

for each of said second lateral walls, said holding section is centrally located between said end sections; and said holding sections of said second lateral walls are symmetrical to each other in the left-right direction.

3. The cosmetic container as claimed in claim 1, wherein said bending portion of said holding section of each of said second lateral walls is U-shaped and opens upward.

4. The cosmetic container as claimed in claim 1, wherein said container body is substantially cuboid in shape and has four rounded bottom corners.

5. The cosmetic container as claimed in claim 1, wherein for each of said second lateral walls, each of said end sections is connected to said base wall, cooperates with said base wall to forma rounded corner, and is connected to said holding section.

6. The cosmetic container as claimed in claim 1, wherein:

said cover includes a main wall that has a flat top wall surface located at a center part of said main wall, a front wall surface and a rear wall surface being spaced apart from each other in the front-rear direction and flanking said top wall surface, and two side wall surfaces being spaced apart from each other in the left-right direction and flanking said top wall surface;

each of said front, rear, and side wall surfaces extends toward said container body and cooperates with said top wall surface to form a rounded corner; and each of said side wall surfaces of said main wall has a depressed section that is depressed toward the other one of said side wall surfaces, and that defines an upper groove communicating with said lower groove of a respective one of said second lateral walls of said container body.

7. The cosmetic container as claimed in claim 6, wherein each of said side wall surfaces of said main wall has a center part which is centrally located with respect to the front-rear direction and in which said upper groove is located, such that said upper grooves of said side wall surfaces are symmetrical to each other in the left-right direction.

8. The cosmetic container as claimed in claim 6, wherein said cover is substantially cuboid in shape and has four rounded top corners.

9. The cosmetic container as claimed in claim 6, wherein each of said side wall surfaces of said main wall has a center part centrally located with respect to a top-bottom direction which is perpendicular to the front-rear direction and the left-right direction, said upper groove of each of said side wall surfaces extending downward from said center part toward said lower groove of the respective one of said second lateral walls.

* * * * *